United States Patent [19]

Couture et al.

[11] 4,417,612

[45] Nov. 29, 1983

[54] POCKET KEY HOLDER

[76] Inventors: Michael V. Couture, 228 Pine St., Holyoke, Mass. 01040; Ronald Keklak, 637 Church St., Amston, Conn. 06231

[21] Appl. No.: 379,366

[22] Filed: May 18, 1982

[51] Int. Cl.[3] ..... A45C 11/32

[52] U.S. Cl. ..... 150/40; 150/42

[58] Field of Search ..... 150/39, 40, 42

[56] References Cited

U.S. PATENT DOCUMENTS

| | | | |
|---|---|---|---|
| D. 220,557 | 4/1971 | Balzano | 150/40 X |
| 1,715,348 | 6/1929 | Barbara | 150/40 |
| 1,877,809 | 9/1932 | L'Enfant | 150/40 |
| 1,995,664 | 3/1935 | Boyes | 150/42 X |
| 2,122,934 | 7/1938 | Economakis | 150/40 |
| 2,527,175 | 10/1950 | Brill | 150/40 |
| 2,571,609 | 10/1951 | Powell | 150/40 |
| 2,635,665 | 4/1953 | Ashley | 150/40 |
| 2,703,596 | 3/1955 | Kromer | 150/40 |
| 3,529,649 | 9/1970 | Bennett | 150/40 |
| 4,286,641 | 9/1981 | Watson | 150/40 |

*Primary Examiner*—William Price
*Assistant Examiner*—Sue A. Weaver
*Attorney, Agent, or Firm*—D. Paul Weaver

[57] ABSTRACT

A pocket key holder constructed essentially from three layers of thin flexible material eliminates bulkiness, expensive hardware and noise caused by continual contact of unrestrained loose keys. Ready identification of multiple keys in separated pockets of the holder by sight or by touch is enabled. Convenience of use and compactness are maximized in a soft yielding structure suitable for carrying in any apparel pocket.

9 Claims, 9 Drawing Figures

FIG. 4
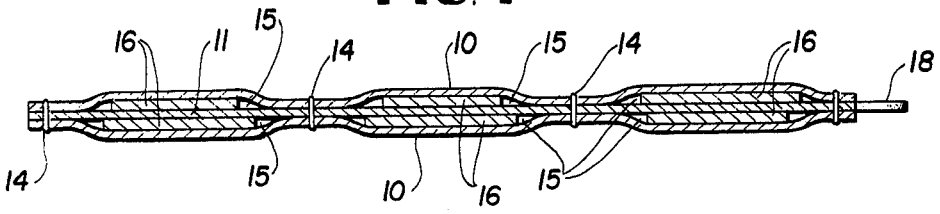
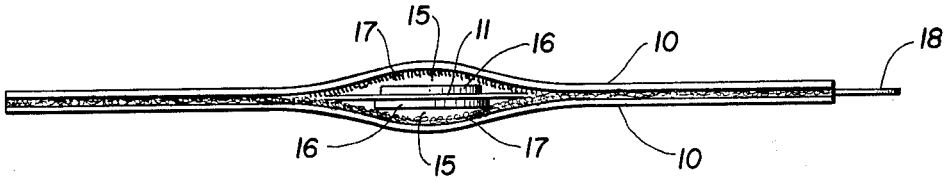
FIG. 5
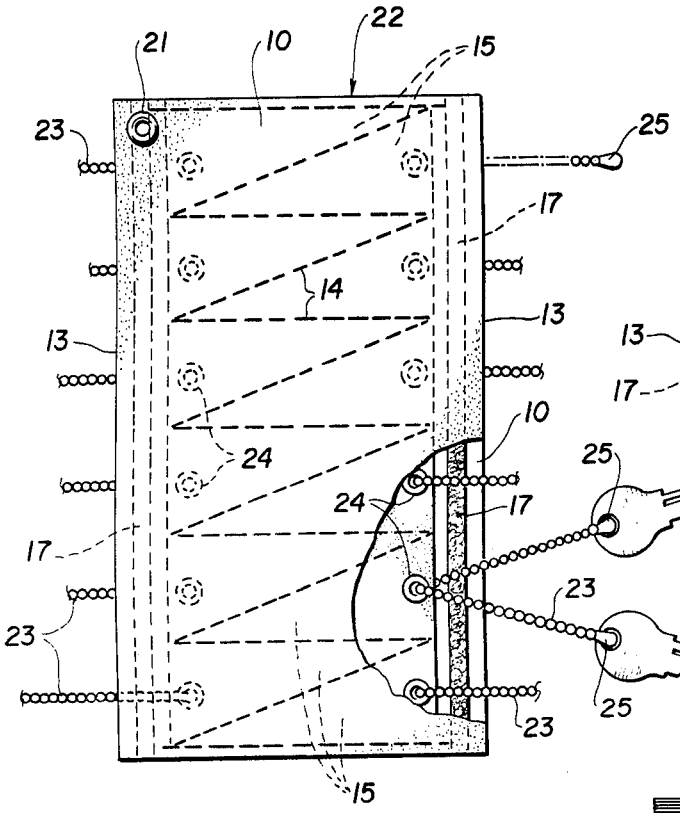
FIG. 7
FIG. 6
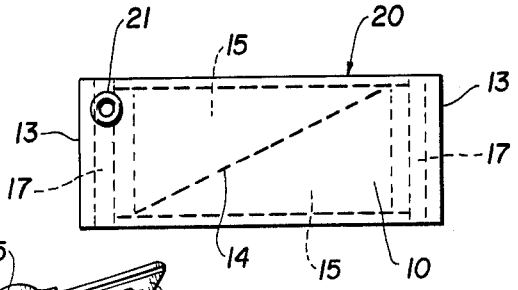
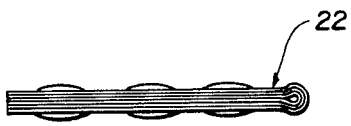
FIG. 8

POCKET KEY HOLDER

BACKGROUND OF THE INVENTION

Key holders in many configurations are known in the prior art. While most of the prior art key holders are useful in varying degrees, there is a recognized need for a better and more convenient pocket key holder which will enable the orderly carrying of a fairly large number of keys in one's pocket without bulkiness, excessive weight, and without annoying noise due to constant jingling of keys and hardware.

Among the objects of the invention is to provide a pocket key holder of minimum bulk and maximum key carrying capacity, where the holder is constructed from soft pliable materials substantially entirely, without the usual metal hardware.

Another object is to provide a pocket key holder in which the keys are contained in an orderly fashion in separated flat pockets, and wherein the keys are readily identifiable by sight or by feel, in the dark and even by blind users of the key holder.

Yet another object is to provide a key holder of the above-mentioned type which an be constructed in various sizes to accommodate a greater or fewer number of keys, the larger size carriers being foldable for placement in a pocket of clothing in a very compact form.

Other features and advantages of the invention will become apparent during the course of the following detailed description.

BRIEF DESCRIPTION OF THE DRAWINGS

FIG. 4 is an enlarged vertical section taken on line 4—4 of FIG. 1.

FIG. 5 is an end elevation of the key holder in a partly open state.

FIG. 6 is a plan view, on a reduced scale, of a second embodiment of the invention.

FIG. 7 is a similar view showing a third embodiment of the invention.

FIG. 8 is an end elevation of the key holder shown in FIG. 7 in a folded state.

DETAILED DESCRIPTION

Figure 1:
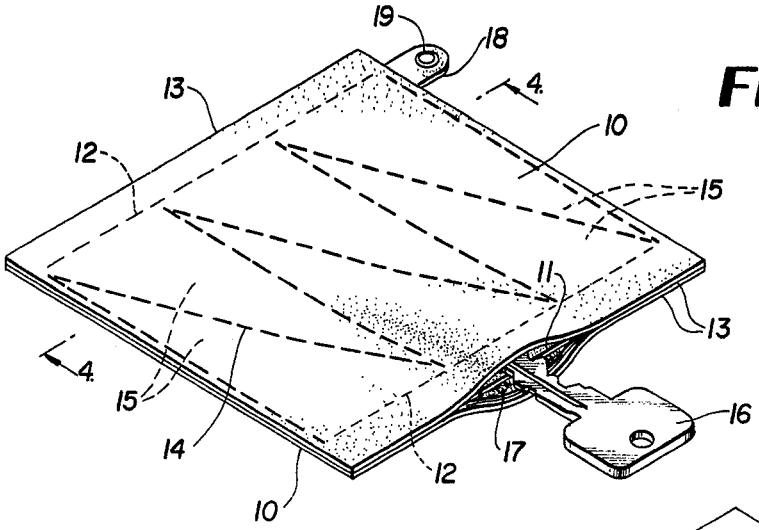
FIG. 1 is a perspective view of a pocket key holder according to one embodiment of the invention.
Figure 2:
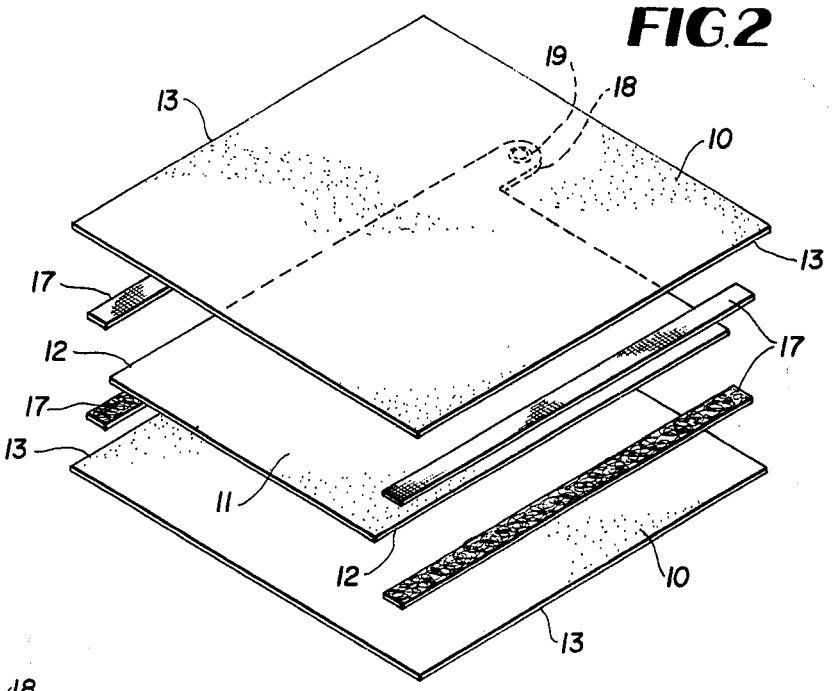
FIG. 2 is an exploded perspective view of the same.

Referring to the drawings in detail wherein like numerals designate like parts and referring first to FIGS. 1 through 5 showing a preferred embodiment, a pocket key holder having the capacity to hold a dozen keys is illustrated. As shown, the key holder is substantially square, thin and flat when in a normal closed state. It is constructed essentially from two outer layers or sections 10 of thin pliable material, such as soft leather, intervened by a third rectangular layer 11 preferably of the same material, the rectangular layer 11 being narrower than the layers 10 in one direction only so that its edges 12 terminate well inwardly of the corresponding parallel edges 13 of the two outer layers 10, which latter edges form closure flaps on opposite ends of the pocket key holder.

The three layers 10, 11, 10 are joined in permanently assembled superposed relationship by a zigzag line of stitching 14 penetrating the three layers as best shown in FIG. 4. Such stitching spans the width of the key holder and extends between the two edges 12 of middle layer 11 to form in the key holder twelve separated tapered key pockets 15 for diverse keys 16.

On each side of the intermediate layer 11 and between it and the two outer layers 10 are six separated pockets 15. The pockets on opposite sides of the layer 11 taper oppositely, FIG. 3, so that they and the keys therein interfit in a most compact manner. The outer ends of the pockets 15 facing the opposite edges 13 are open to receive the keys and allowing their ready withdrawal. The entire structure is thin, soft and pliable. The keys are arranged and held in an orderly manner without being bunched together and without direct contact causing rattling or jingling of keys as in many prior art devices. The structure is substantially without metal hardware.

Figure 3:
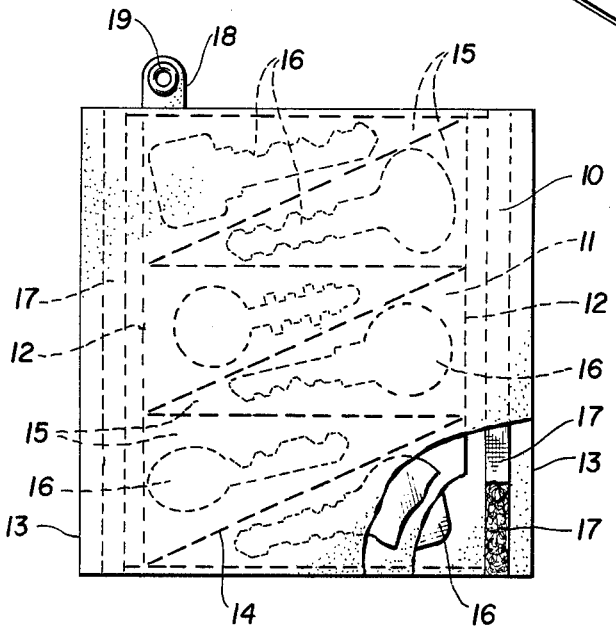
FIG. 3 is a plan view of the key holder.

A very simplified flexible and convenient closure for the opposite parallel edges 13 and for the mouths of the opposing pockets 15 is provided in the form of a coacting pair of narrow VELCRO-type strips 17 having a multitude of coacting minute hooks and pile loops, attached conventionally to the opposing interior faces of the two outer layers 10 outwardly of the two edges 12 of the middle layer 11 and between them and the two edges 13, as best shown in FIG. 3. The strips 17 span transversely the mouths of all twelve key pockets 15.

To open either end of the pocket key holder, the edges 13 of outer layers 10 are grasped and pulled apart with sufficient force to separate the two closure strips 17 adjacent to one pair of key pockets 15, FIG. 5, or several pairs as need dictates. To close the holder, it is merely necessary to press the closure strips 17 together, and a very secure closure is formed. The closure means, as well as the body of the key holder, is soft and pliable for comfort in the pocket and maximum compactness.

Preferably, a corner projecting tab 18 having an eyelet 19 is formed on the center layer 11. This tab extends beyond one side edge of the holder and forms a ready means of anchoring the holder to a body-attached chain or the like. The tab 18 also forms a convenient indicator enabling the user to locate any particular key even in the dark. The tab 18 will assist a blind user of the device. Particular keys 16 are placed in particular pockets of the holder and the user references these keys by sight or feel to the indicator tab 18. For example, in the dark, the user may place the front door key in the third pocket away from the tab 18 on one side of the holder, or in any other chosen pocket. The tab 18 is simply located by feel and the pockets can be counted with relation to the tab in order to quickly find any given key. In addition, labels may be placed on or near the pockets as an optional means of identification of keys.

FIG. 6 shows a modified smaller key holder 20 for four keys constructed substantially in the same manner described for the device in FIGS. 1–5. Size is the only significant difference. In lieu of the tab 18, which is preferred, a metal eyelet 21 may be placed through one corner of the key holder as shown in FIG. 6 to serve as an anchor as well as an indicator.

FIGS. 7 and 8 depict a modified pocket key holder 22 having a twenty-four key capacity and being foldable in half due to its flexible nature, FIG. 8, for ready placement in the pocket. The basic construction remains as described in the first embodiment, FIGS. 1–5, and need not be repeated for a proper understanding of the invention. The key holder 22 is elongated and rectangular instead of square as in FIG. 1. The corner eyelet 21 or the projecting tab 18 can be utilized. It should now be apparent that the key holder can be made in a range of sizes as deemed necessary and practical.

As shown in FIG. 7 only, keys 16, if desired, can be tethered by chains 23 or the like to the holder. The chain or other material is attached at each end by quick-release snaps 25 to one of two keys which lie on either side of the middle layer 11. The chain is run through small eyelets 24 placed along the opposite edges of the middle layer 11. The chains are a further security means preventing loss of keys, and locating particular keys with relation to particular pockets.

The diverse utility, convenience and economy of manufacturing of the device, its compactness and other discussed advantages should now be apparent to those skilled in the art.

Figure 9:
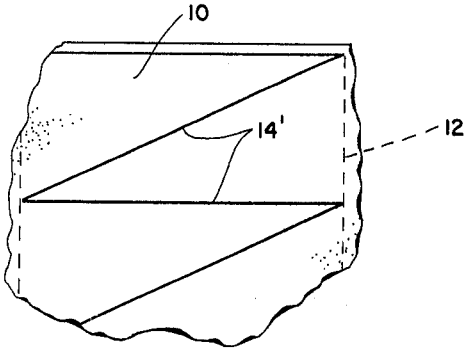
FIG. 9 is a fragmentary plan view of a pocket key holder according to the invention formed from layers of heat sealable material, connected by a zigzag heat sealed line.

In lieu of zigzag stitching line 14 and in lieu of leather for the layers or sections 10 and 11, such layers or sections can be formed of heat sealable material connected by a zigzag heat sealed line 14' as shown in FIG. 9 of the drawings.

It is to be understood that the forms of the invention herewith shown and described are to be taken as preferred examples of the same, and that various changes in the shape, size and arrangement of parts may be resorted to, without departing from the spirit of the invention or scope of the subjoined claims.

We claim:

1. A pocket key holder comprising a pair of outer flexible sheets of like size having opposite parallel edges adapted to register when the outer sheets are in superposed relationship, an intermediate flexible sheet between said outer sheets in sandwiched relationship and having opposite parallel edges spaced inwardly from the corresponding edges of the outer sheets so that said outer flexible sheets will form closure flaps along opposite ends of the key holder, connecting means for all of said sheets following a zigzag path across the sheets and forming on the key holder multiple tapering and interfitting key pockets on each side of the intermediate sheet and between it and said outer sheets, said pockets having open ends facing said parallel edges of the outer sheets, the open ends of the key pockets on opposite sides of the intermediate sheet facing in opposite directions toward opposite ends of the key holder, and coacting flexible closure strips on the interior surfaces of the closure flaps between the parallel edges of the outer and intermediate sheets, said closure strips being of a type which form a secure continuous closure when pressed together and may be pulled apart to separate the closure flaps.

2. A pocket key holder as defined in claim 1, and said closure strips comprising narrow VELCRO strips spaced from and parallel to the edges of the outer and intermediate sheets.

3. A pocket key holder as defined in claim 1, wherein said connecting means comprises a zigzag line of stitching.

4. A pocket key holder as defined in claim 1, and said flexible sheets being formed of heat sealable material and said connecting means comprising heat sealing.

5. A pocket key holder as defined in claim 1, and said pair of outer sheets and the intermediate sheet being rectangular, the intermediate sheet being narrower than the outer sheets on one orthogonal axis common to all of the sheets.

6. A pocket key holder as defined in claim 1, and a corner indicator and anchoring element on the key holder enabling it to be attached to a tether on the body of a user and facilitating by sight and/or touch the location of a particular key in a particular key pocket.

7. A pocket key holder as defined in claim 1, and said pair of outer flexible sheets being substantially square and defining the marginal edges of the key holder.

8. A pocket key holder as defined in claim 1, and said pair of outer sheets being rectangular and elongated on one orthogonal axis, whereby a greater number of the key pockets can be provided in the key holder and the latter can be folded in two upon itself on the other orthogonal axis to produce a more compact structure.

9. A pocket key holder as defined in claim 6, and said corner indicator and anchoring element comprising a projecting tab element on one corner of the intermediate sheet and extending beyond the margin of the key holder near one corner thereof.

* * * * *